US006146175A

United States Patent [19]

Shibata

[11] Patent Number: 6,146,175

[45] Date of Patent: Nov. 14, 2000

[54] BOARD CONNECTORS HAVING A LOW PROFILE AND WHICH UNDERGO A WIPING EFFECT WHEN COUPLED

[75] Inventor: Junichiro Shibata, Tokyo, Japan

[73] Assignee: NEC Corporation, Tokyo, Japan

[21] Appl. No.: 09/100,657

[22] Filed: Jun. 19, 1998

[30] Foreign Application Priority Data

Jun. 20, 1997 [JP] Japan ..... 9-164735

[51] Int. Cl.[7] ..... H01R 13/28; H01R 25/00

[52] U.S. Cl. ..... 439/284; 439/374

[58] Field of Search ..... 439/284, 294, 439/374, 287, 289, 74

[56] References Cited

U.S. PATENT DOCUMENTS

| | | | |
|---|---|---|---|
| 3,245,024 | 4/1966 | Evans | 439/67 |
| 4,418,975 | 12/1983 | O'Keefe, II | 439/344 |
| 4,506,940 | 3/1985 | Asick et al. | 439/290 |
| 4,678,121 | 7/1987 | Douty et al. | 439/610 |
| 5,137,462 | 8/1992 | Casey et al. | 439/374 |
| 5,378,160 | 1/1995 | Yumibe et al. | 439/66 |
| 5,879,169 | 3/1999 | Wu | 439/74 |

FOREIGN PATENT DOCUMENTS

| | | |
|---|---|---|
| 56-51275 | 9/1954 | Japan . |
| 60-48685 | 4/1985 | Japan . |
| 61-93986 | 6/1986 | Japan . |
| 63-43774 | 3/1988 | Japan . |
| 5-33486 | 4/1993 | Japan . |
| 5-275147 | 10/1993 | Japan . |
| 6-5165 | 1/1994 | Japan . |
| 6-124754 | 5/1994 | Japan . |
| 6-215837 | 8/1994 | Japan . |
| 7-220825 | 8/1995 | Japan . |
| 8-55657 | 2/1996 | Japan . |
| 8-88062 | 4/1996 | Japan . |
| 10-97878 | 4/1998 | Japan . |

OTHER PUBLICATIONS

Japanese Office Action issued Nov. 30, 1999 in a related application.

English translation of relevant portions of Nov. 30, 1999 Japanese Office Action.

*Primary Examiner*—Neil Abrams
*Assistant Examiner*—Hae Moon Hyeon
*Attorney, Agent, or Firm*—Ostrolenk, Faber, Gerb & Soffen, LLP

[57] ABSTRACT

A board-connection connector for making connections between electronic circuit boards has a planar housing that is fixed to an electronic circuit board, with contacts provided on the upper surface of this housing. The side surface of the housing has a guide groove and a mating protrusion which mates by insertion into the guide groove of the connector another electronic circuit board having a corresponding mating protrusion and guide groove.

23 Claims, 6 Drawing Sheets

BOARD CONNECTORS HAVING A LOW PROFILE AND WHICH UNDERGO A WIPING EFFECT WHEN COUPLED

BACKGROUND OF THE INVENTION

1. Field of the Invention

The present invention relates to a pair of board connectors which are used in an information processing apparatus, such as a personal computer, to make direct,mutual connections between direct connection to an electronic circuit boards, without an intervening cable.

2. Description of Related Art

Accompanying developments in electronic equipment and in production technology, electronic equipment is becoming lighter and more compact. There is a particular trend in recent years to slim electronic equipment.

However, the functions demanded of such equipment are the same or greater than in the past, and often a single board is not sufficient. This makes it necessary to use a plurality of electronic circuit boards.

In such cases, because of the need for a low profile, the approach is generally that of connecting a plurality of boards together by means of a low-profile connector, so that the boards can be stacked with a small amount of space between them.

The connectors shown in FIG. 8 and FIG. 9 are known as such low-profile board connectors.

The connector shown in FIG. 8(*a*) is made up of a pair of connectors, the male connector 110 and a female connector 120, each being fixed to an electronic circuit board 130.

The male connector 110 has vertical contacts 111 that stand up vertically from the electronic circuit board 130, and the female connector 120 has contacts 121 which make contact with the sides of the vertical contacts 111, these contacts 121 standing up from the electronic circuit board 130.

The electronic circuit board 130 onto which the female connector 120 is mounted has holes 131 for the passage of the vertical contacts 111.

The connector shown in FIG. 9(*a*) has a male connector 110 such as is shown in FIG. 8, however, the contacts 141 of the female connector 140 in this case are formed so as to be disposed on the inside of a hole 132 that is provided in the electronic circuit board 130, so that gauge formed between the circuit boards 130, is reduced.

When making mutual connections between these connectors, as shown in FIG. 8(*b*) and FIG. 9(*b*), the vertical contacts 111 of the male connector 110 pass through the holes 131 and 132 of the female connectors 120 and 140, respectively, the vertical contacts 111 of the male connector 110, mating and making physical contact with the contacts 121 and 141 of the female connectors 120 and 140, respectively.

The connectors such as shown in FIG. 8 and FIG. 9, however, have the following problems.

The first problem is the need to make the above-noted holes in the electronic circuit board. The making of a hole in the board increases the number of fabrication steps and the cost of the board, and also results in a decrease in the strength of the electronic circuit board.

The approach of having the vertical contacts of the male connector pass through holes in the electronic circuit board to which the female connector is fixed compensates for the shortened effective mating length of the contacting parts that results from the low height of the connector. This increases the effective mating length.

The second problem is that, in a connector of the past, a low-profile connector has a structure that achieves little wiping effect in its contacts, so that there is a possibility that the attachment of foreign matter therein can cause a bad contact.

The reason for this is that, by making the spacing between the boards small, the effective mating length between the connectors becomes shortened, so that a cleaning effect from the wiping of the contacts when the connectors are mated might not be achieved.

For this reason, there is a possibility that foreign matter becomes lodged between the contacts, thereby lowering the contact reliability.

OBJECTS AND SUMMARY OF THE INVENTION

In view of the above-described drawbacks in the prior art, an object of the present invention is to provide a low-profile board-connection connector which enables the spacing between boards to be made small, and which can be cleaned effectively by wiping without having to make a hole in the electronic circuit board.

An additional object of the present invention is to provide a low-profile board-connector connector that is easy to manufacture and low in cost.

To achieve the above-noted objects, a low-profile board-connection connector pair of the present invention basically has the technical conception in that a board-connection connectors set comprising a pair of board-connection connectors which make mutual connection between electronic circuit boards, the pair of connectors comprising, a first board-connection connector comprising a first electronic circuit board and a first planar housing which is fixedly mounted on a main surface of the first electronic circuit board and a plurality of first contacts being provided on an opened main surface of the first planar housing, and a second board-connection connector comprising a second electronic circuit board and a second planar housing which is fixedly mounted on a main surface of the second electronic circuit board and a plurality of second contacts being provided on an opened main surface of the second planar housing and each of which being corresponding to the respective the first contacts, and wherein, on at least one of side wall portions of the first planar housing of at least the first electronic circuit board, and the wall portion being arranged in a direction parallel to a main sliding direction to which the first and second planar housings relatively moving with respect to each other, a first guide groove is provided in parallel with the main surface of the first planar housing, and on at least one of side wall portions of the second planar housing of at least the second electronic circuit board, and corresponding to the wall portion of the first planar housing, a first insertion member which being protruded upwardly from the side wall portion thereof, and which being inserted into the first guide groove is provided, so as to contact the first and second contacts to each other when the first insertion member and the first guide groove are mated to each other.

More specifically, the board-connection connector pair of the present invention comprising a first board-connection connector having a planar housing that is fixed to the above-noted electronic circuit board, a plurality of contacts that are provided on the upper surface of the housing and guide grooves that are formed along a direction that is parallel to the upper surface of the housing on both sides in the longitudinal direction, for example, the second board-connection connector having a planar housing that is fixed to the above-noted electronic circuit board, a plurality of contacts that correspond in position to the plurality of contacts of the first board-connection connector and insertion members which protrude from the housing along the longitudinal direction sides thereof, for example, and which are inserted into so as to mate with the guide grooves of the first board-connection connector. B By sliding the insertion members of the second board-connection connector into the guide grooves of the first board-connection connector that these mate, these board-connection connector are mechanically linked, and there is electrical connections made between the contacts in the upper surface of the housing thereof, which make mutual physical contact.

According to the present invention configured as noted above, with the guide grooves and insertion members of these board-connection connectors mated, the upper surfaces of the housings are either in physical contact with one another or are extremely close to one another, and because the housings that are fixed to the electronic circuit boards are planar, the connector thickness is small, making it possible to reduce the spacing between the electronic circuit boards, thereby enabling the implementation of a low-profile connector.

Additionally, because the connectors are mated by a sliding action, the rubbing of mating contacts when the connectors are mated together achieves sufficient wiping effect, thereby resulting in high contact reliability.

Additionally, because the contacts are mated by a sliding action, in contrast to vertical insertion mating, there is no need to have the contacts pass through an electronic circuit board, thereby eliminating the need to make holes in the electronic circuit boards.

DETAILED DESCRIPTION OF THE PREFERRED EMBODIMENTS

Embodiments of a low-profile board-connection connector according to the present invention are described below, with reference being made to the relevant accompanying drawings.

The present invention is, however, not limited to the embodiments presented below.

Figure 1A:
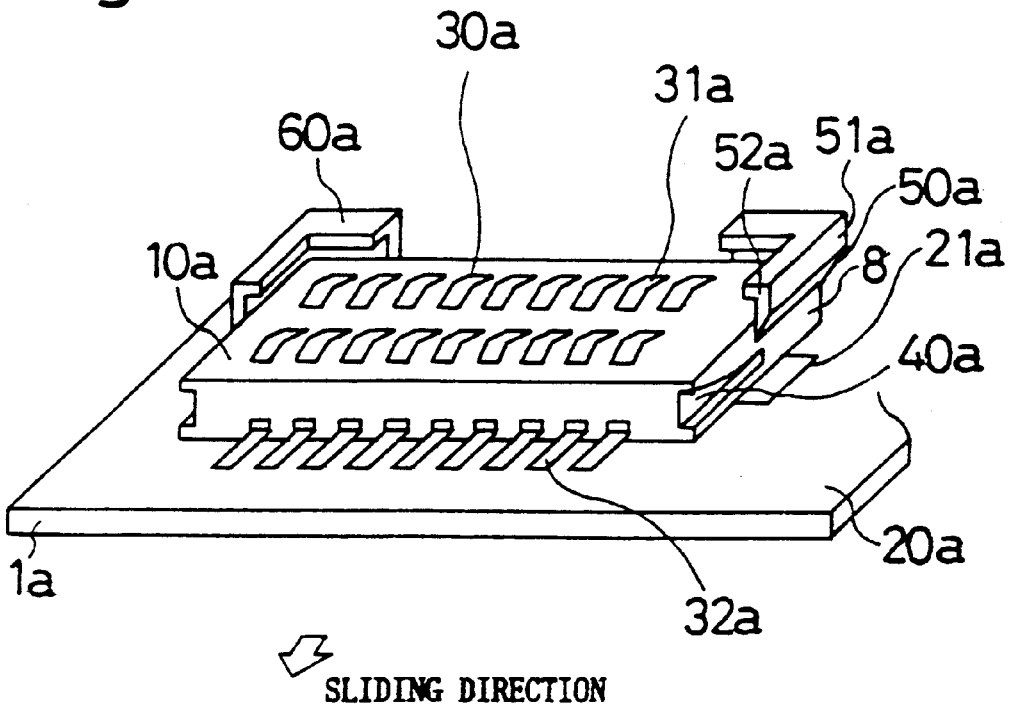
FIG. 1 is a perspective view which shows a low-profile board-connection connector according to the first embodiment of the present invention, with (a) showing the male connector and (b) showing the female connector.
Figure 1B:
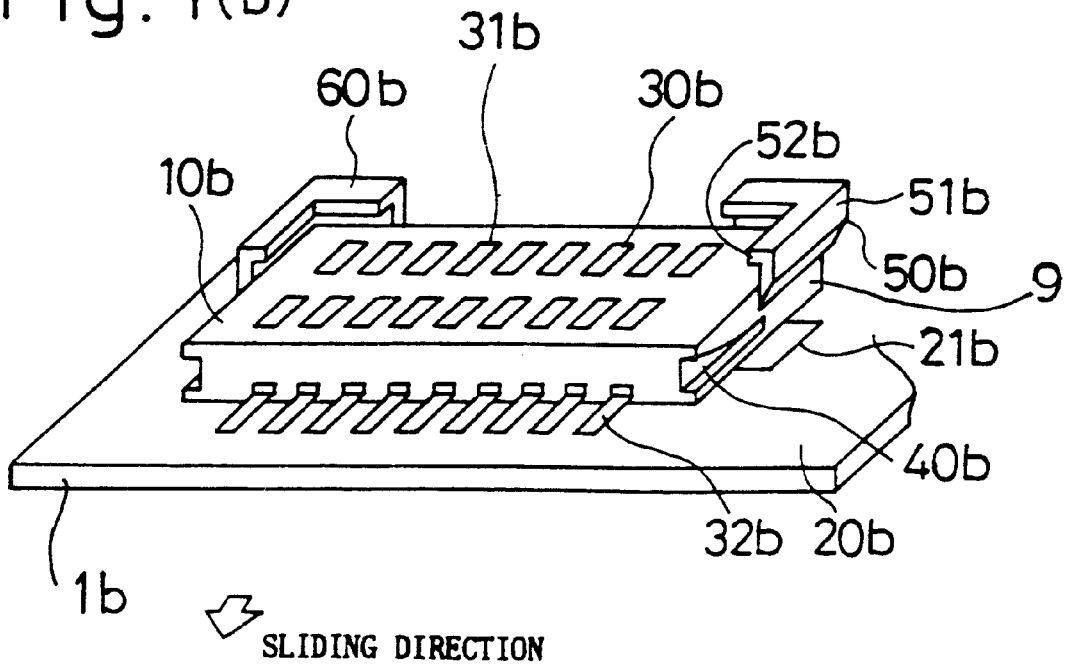

FIG. 1 is a drawing which shows the first embodiment of a low-profile board-connection connector pair according to the present invention, with FIG. 1(*a*) showing a perspective view of the male board-connection connector, i.e., a first connector and FIG. 1(*b*) showing a perspective view of the female board-connection connector, i.e., a second connector.

In FIGS. 1(*a*) and 1(*b*), a board-connection connectors pair is shown and in that the board-connection connectors pair comprising a pair of board-connection connectors 1*a* and 1*b* which make mutual connection between electronic circuit boards 20*a* and 20*b*, the pair of connectors comprising a first board-connection connector 1*a* including a first electronic circuit board 20*a* and a first planar housing 10*a* which is fixedly mounted on a main surface of the first electronic circuit board 20*a*. A plurality of first contacts 30*a* are provided on an opened main surface of the first planar housing 10*a*. A second board-connection connector 1*b* includes a second electronic circuit board 20*b* and a second planar housing 10*b* fixedly mounted on a main surface of the second electronic circuit board 20*b*. A plurality of second contacts 30*b* are provided on an opened main surface of the second planar housing 10*b*, each of which a corresponding to the respective first contact 30*a*. At least one side wall portion 8 of the first planar housing 10*a* of at least the first electronic circuit board 20*a*, is disposed in a direction parallel to a main sliding direction to which the first and second planar housings 10*a* and 10*b* relatively move with respect to each other. A first guide groove 40*a* is provided in parallel with the main surface of the first planar housing 10*a*. On at least one of side wall portions 9 of the second planar housing 10*b* of at least the second electronic circuit board 20*b*, and corresponding to the wall portion 8 of the first planar housing 10*a*, a first insertion member 50*b* protrudes upwardly from the side wall portion 9 thereof, and is effective to be inserted into the first guide groove 40*a* so as to contact the first and second contacts 30*a* and 30*b* to each other when the first insertion member 50*b* and the first guide groove 40*a* are mated to each other.

In accordance with the first embodiment of the present invention, as shown in FIGS. 1(*a*) and 1(*b*), a specific aspect of the board-connection connector pair is such that a male board-connection connector 1*a*, i.e., a first connector 1*a* (hereinafter simply referred to as the male connector) has a thick planar rectangular first housing 10*a*, this first housing is fixed to the first electronic circuit board 20*a* by the terminal part of the contacts to be described later, which is soldered to the electronic circuit board 20*a*. This mounting is preferably reinforced by the soldering reinforcement fixture 21*a*. Mounting to the board is also possible, for example, by using a screw.

The first housing 10*a* has arranged on it a first contact, i.e., the male contacts 30*a*. The male contacts 30*a* are band-shaped metal strips that are parallel to a main sliding direction, i.e., an insertion direction as indicated in the drawing.

These male contacts, i.e., the first contacts 30*a* are buried in the first housing 10*a*, and the upper surface of the first housing 10*a* has protruding contact parts 31*a* that are exposed therealong, and terminal parts 32*a* that protrude from a side of the first housing 10*a* facing the main sliding direction and that make electrical contact with the first electronic circuit board 20*a*.

The protruding contacts 31*a* of the first contacts, i.e., the male contacts 30*a*, arch upward from the surface of the first housing, this shape imparting a springiness to the contacts.

While contacts are often arranged along the surface of a housing, in this embodiment, they are formed so as to be buried into the housing. This is because the rear-side contacts can be lifted up and deformed when sliding mating is done.

For example, on both side surfaces in parallel with sliding direction of the first housing 10*a* (hereinafter referred to as the short sides), a first guide groove 40*a* is formed along a direction that is parallel to the upper surface of the housing 10*a* up at least until a center part of the short sides.

Proceeding from the front side to the rear side, the upper side of these first guide grooves 40*a* gradually approach the bottom surfaces of the guide grooves, so that the first groove 40*a* forms a taper shape, the width at the rearmost part thereof being the width for mating with the mating protrusion which will be described later.

Protruding from the top part of the left and right short sides of the first housing 10*a*, there is a second insertion member 50*a* formed.

This second insertion member 50*a* has a support plate 51*a* that protrudes from the upper surface of the first housing, extending, for example, from the approximate center of the left and right short sides of the first housing 10*a* to the rear-side surface thereof, and mating protrusions 52*a*, which extend outward horizontally from the end parts of these support plates 51*a*.

These mating protrusions 52*a* mate with guide grooves 40*b* of the female board-connection connector, i.e., a second connector 1*b* to be described later (hereinafter simply referred to as the female connector).

Additionally, on the rear surface of the first housing 10*a*, a stopper 60*a* is provided so as to protrude outward perpendicularly from the upper surface of the first housing.

This stopper 60*a* is formed on the insertion part 50*a*. When the male connector, i.e., the first connector 1*a* and the female connector, i.e., the second connector 1*b* are slid together so as to mate with one another, the stopper 60*a* is butted up against by the surface of the second housing 10*b* of the female connector 1*b*, so that there is accurate overlap of the first and second housings 10*a* and 10*b* of the first connector 1*a* and the second connector 1*b*.

The female connector, i.e., the second connector 1*b*, with the exception of the contact part that has the contacts, has almost the same configuration as the male connector 1*a*.

This connector has a second guide groove 40*b* provided on the right and left short sides (in the main sliding direction) of the second housing 10*b*, and these second guide grooves mate with the first insertion parts 50*a* of the male connector, i.e., the first connector 1*a*.

On the right and left short sides of the second housing 10*b* there is provided with a first insertion part 50*b*, which mates with the first guide grooves 40*a* of the first connector, i.e., the male connector 1*a*, these first insertion parts 50*b* protruding upward from the housing 10*b*.

The first insertion parts 50*b* have a mating protrusion 52*b* which extends horizontally outward so as to be in mutual opposition with a support plate 51*b* that stands upward from the left and right short sides of the housing 10*b*.

At the rear surface of the second housing 10*b*, there is provided a stopper 60*b* which extends upward from the housing 10*b*.

The female contacts, i.e., the second contacts 30*b*, are band-shaped metal members, add are arranged on the second housing 10*b* so that they are parallel to the sliding direction, i.e., the insertion direction.

These second contacts, i.e., the female contacts 30*b* are buried in the second housing 10*b*, and provide electrical coupling the terminals 32*b*, which are electrically connected to the electronic circuit board 20*b*, and to the second contacts, i.e., the female contacts 30*b*.

The second contacts 30*b* are either flat with or slightly recessed from upper surface of the second housing 10*b*, and are provided in positions that correspond to the protruding contact parts 31*a* of the first connector, i.e., the male connector 1*a*.

The second connector 1*b* is fixed to the second electronic circuit board 20*b* by soldering the terminals on the terminal part 32*b* to the second electronic circuit board, this mounting to the second electronic circuit board 20*b* being reinforced by the soldering reinforcement fixture 21*b*.

Next, the method of mating the first connector 1*a* together with the second connector 1*b* so as to mutually connected the first and the second electronic circuit boards will be described, with references being made to FIG. 2 through FIG. 5.

In these drawings, (a) is a plan view of the connectors (showing the bottom surface of the female connector), and (b) is a side view of the connectors. For the purpose of this description, only the connectors are shown in the plan view, the electronic circuit boards being omitted.

Figure 2A:
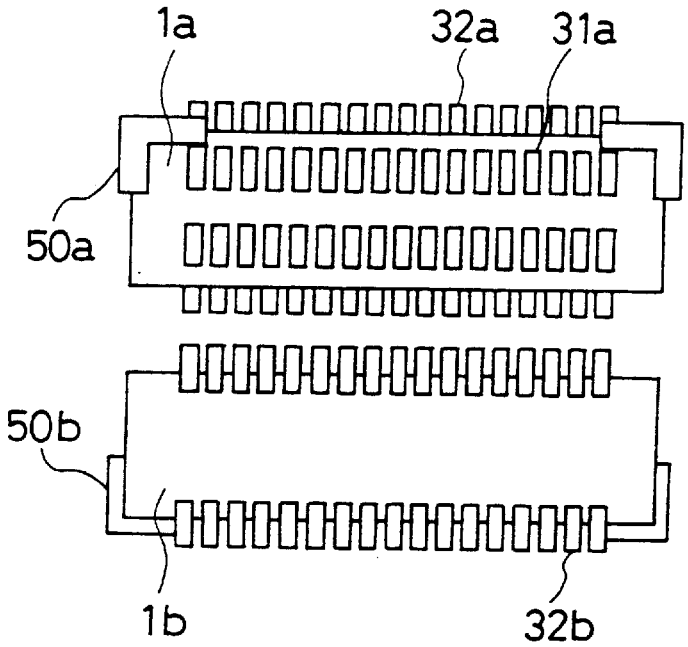
FIG. 2 is a drawing which shows the first step in mating the low-profile board-connection connectors shown in FIG. 1, with (a) showing a plan view and (b) showing a side view.
Figure 2B:
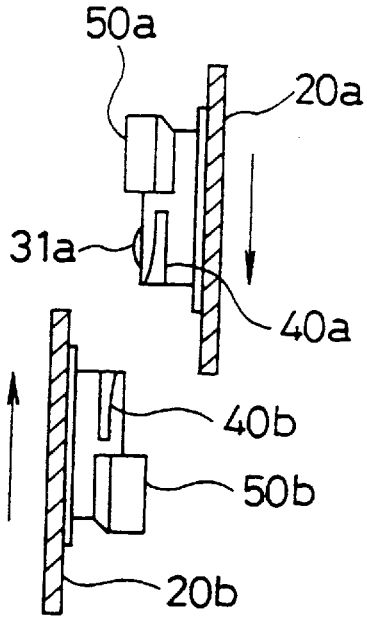

First, referring to FIG. 2(*a*) and FIG. 2(*b*), the male connector 1*a* and the female connector 1*b*, i.e., the first and second connector, respectively, are brought into opposition to one another, so that the top surfaces of the first and second housings of each connectors, face each other.

Figure 3A:
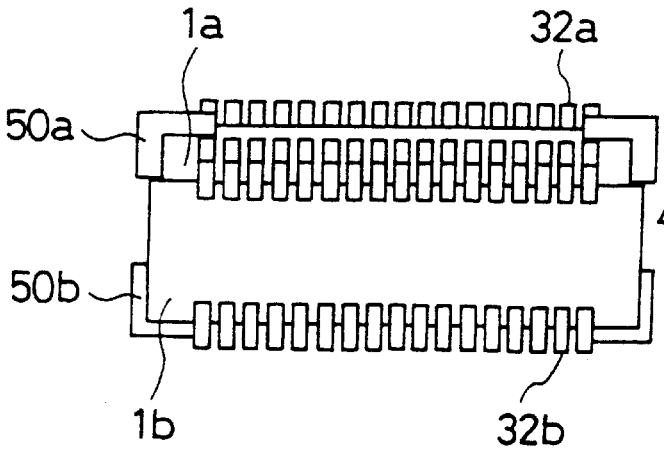
FIG. 3 is a drawing which shows the next step after FIG. 2 in mating the low-profile board-connection connectors of FIG. 1, with (a) showing a plan view and (b) showing a side view.
Figure 3B:
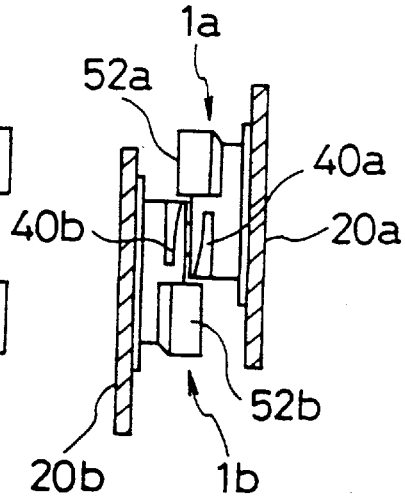
Figure 4A:
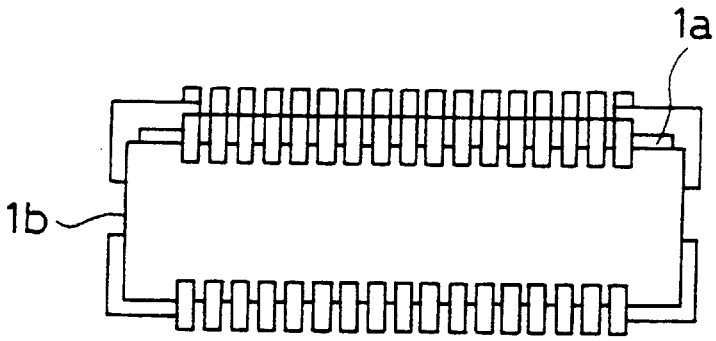
FIG. 4 is a drawing which shows the next step after FIG. 3 in mating the low-profile board-connection connectors of FIG. 1, with (a) showing a plan view and (b) showing a side view.
Figure 4B:
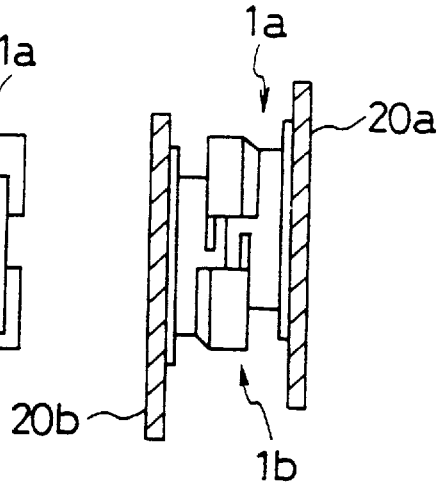

Next, as shown in FIG. 3(*a*) and FIG. 3(*b*), the first connector 1*a* and the second connector 1*b* are moved toward each other. By doing so, the mating protrusion 52*a* of the first connector 1*a* is inserted into the second guide groove 40*b* of the second connector 1*b*, and the mating protrusion 52*b* of the second connector 1*b* is inserted into the first guide groove 40*a* of the first connector 1*a*.

As the first connector 1*a* and the second connector 1*b* are moved forward further, the mating protrusion 52*a* of the first connector 1*a* enters into the guide groove 40*b* of the second connector 1*b*, and the mating protrusion 52*b* of the second connector 1*b* enters into the first guide groove 40*a* of the male connector 1*a*. That is, the connectors are slid together so that they mate.

Figure 5A:
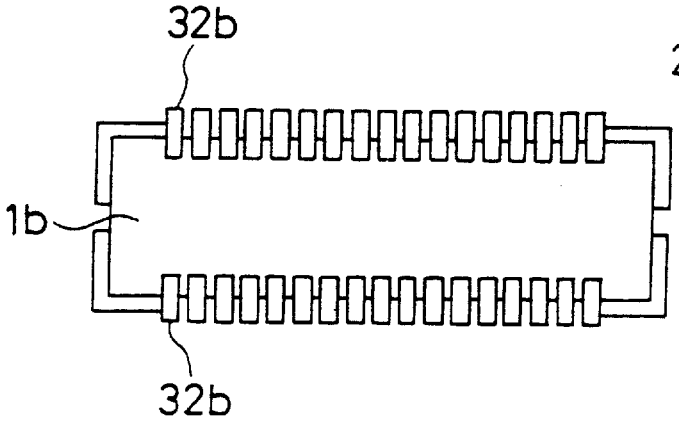
FIG. 5 is drawing which shows the mated condition of the low-profile board-connection connectors of FIG. 1, with (a) showing a plan view and (b) showing a side view.
Figure 5B:
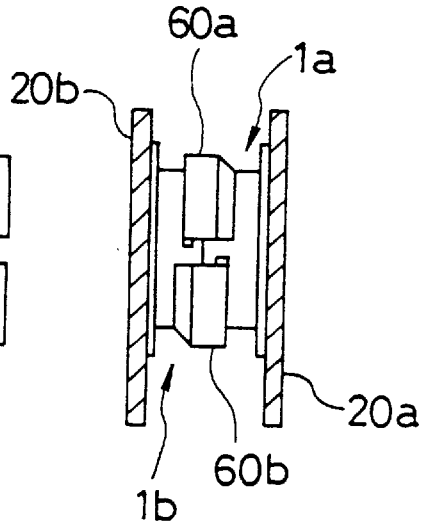

Since the upper side surfaces of the first and second guide grooves 40*a* and 40*b* (the wall surfaces that are closer to the other connector) are gradually inclined so that the distance from the upper surface becomes successively larger with progression away from the entrance of the guide grooves, the mating protrusions 52*a* and 52*b* are guided by the upper side surfaces of the first and the second guide grooves 41*a* and 41*b*, so that the upper surfaces of the first and the second housings 10*a* and 10*b* are brought into proximity with one another as the sliding insertion action proceeds. Accompanying this, the protruding connector part 31*a* of the first connector contacts 30*a*, which protrude from the upper surface of the first connector housing 10*a*, are brought into contact with the contact part 31*b* having the second contacts 30*b*. If the sliding proceeds further, the protruding contacts 31*a* proceed forward while pressing onto the second contact part 31*b*. Finally, as shown in FIG. 5, the front surfaces of the first and the second housings 10*a* and 10*b* butt up against the stopper of the other connector. At this point the insertions are stopped.

By doing this, the respective first and second guide grooves 40*a* and 40*b* of the first connector 1*a* and the second connector 1*b*, respectively, mate with the first and the second insertion members 50*a* and 50*b*, respectively, so that the upper surfaces of the respective first and second housings 10*a* and 10*b* overlap as they press up against each other. This brings the first connector 1*a* and the second connector 1*b* into a mechanically linked condition.

In addition to this mechanical linkage, the first contacts 30*a* of the first connector 1*a* and the second contacts 30*b* of the second connector 1*b* are in mutual electrical contact. In this condition, the protruding contact part 31*a* having the first contacts is strongly pressed against the second contacts 30*b*, by virtue of the springiness of the protruding first contacts 30*a*.

As shown in FIG. 5(*b*), the spacing between the first and the second electronic circuit boards 20*a* and 20*b*, connected by means of the low-profile board-connection connector according to the first embodiment of the present invention, is the sum of the thicknesses of the first and the second housings 10*a* and 10*b* of the first connector 1*a* and the second connector 1*b*, respectively. This makes it possible to implement an extremely low-profile connector.

In contrast to a vertical connector of the past, these contacts are arranged parallel to the direction of insertion and slide while making contact. There is also no structure with contacts protruding through the electronic circuit board, thereby eliminating the need to make holes in the board.

Additionally, because contacts rub across each other as when the first connector and the second connector are mated together, there is sufficient wiping effect, that is, a sufficient cleaning effect with respect to the contacts. This makes it difficult for attached foreign matter to cause bad connections. The result is a highly reliable connection.

In the first embodiment, although it is explained that the first and the second guiding grooves 40*a* and 40*b* as well as the first and the second insertion members 50*a* and 50*b*, are provided on short side walls of each one of the first and the second housings 10*a* and 10*b*, the embodiment of the present invention is not restricted to this embodiment as these grooves and insertion members can also be provided on the long side wall thereof.

In the present invention, the above-noted contacts are band-shaped, these being arranged in parallel with the direction of insertion of the housing and disposed along the upper surface of the housing with this arrangement.

Even if the profile is still made low, it is possible to cause the contacts disposed along the upper surface of the housing to mate reliably with one another.

Also, because the contacts are arranged in parallel with the insertion direction of the housing, it is possible to have contacts rub together when the connectors are mated, thereby achieving a reliable wiping effect.

In a low-profile board-connection connector of the present invention, the board-connection connectors have the above-noted guide grooves and insertion members, so that there is mutual mating by insertion of an insertion member into the guide groove of the other connector. By virtue of this configuration, the present invention achieves a sure mechanical linking by mutual mating, and an improvement in reliability.

In a low-profile board-connection connector of the present invention, one of the connectors has a protruding springy contact protruding upward from the upper surface of the housing thereof, so that when the insertion member of one connector is inserted by sliding into the guide groove of the other, the protruding contact advances while pressing against the surface of an opposing contact. By virtue of this configuration of the present invention, when the board-connection connectors are mutually mated by sliding, the pressure and sliding between the protruding contact and the mating contact, causes a reliable wiping effect, thereby achieving a highly reliable contact. According to another embodiment of a low-profile board-connecting connector of the present invention, both of the board-connection connectors have a protruding springy contact protruding from the upper surface of the housing thereof, the above-noted guide groove, and the above-noted insertion member so that the connectors are hermaphroditic. Since the connectors are of the same configuration, it is only necessary to manufacture one type of connector, thereby enabling a great reduction in the cost of manufacturing.

In the board-connection connector pair of the present invention, at least one of the first insertion member and the first guide groove may be provided on the wall portion arranged in parallel with the main sliding direction, and along a full range of a length of the wall portion.

In the board-connection connector pair of the present invention, at least one of the first insertion member and the first guide groove may be provided on the wall portion of the respective first and second planar housings, arranged in parallel with the main sliding direction, and along a partial range of the respective wall portions.

Further, in the board-connection connector pair of the present invention, both the insertion member and the guide groove are provided on the same wall portion of the respective the first and second planar housings, and arranged in parallel with the main sliding direction, and along a partial range of a length of the wall portion.

Moreover, in the board-connection connector pair of the present invention, the first guide groove and a second insertion member may be provided on the wall portion of the first planar housing, while the first insertion member and a second guide groove are provided on the wall portion of the second planar housing.

In the board-connection connector pair of the present invention, the first and second insertion members can be provided on a portion of the first and second planar housings, respectively, which is close to a front end thereof with respect to the main sliding direction. Alternatively, the first and second guide grooves of the board-connection connector pair may be provided on a portion of the first and second planar housings, respectively, which is close to a rear end thereof with respect to the main sliding direction.

The board-connection connector pair of the present invention can include each one of the first and second board-connection connectors having the guide grooves and the insertion members, so the insertion members are mated by inserting into the corresponding guide grooves.

In the board-connection connector pair of the present invention, a stopper means is provided at an end portion of the respective guide groove.

Further, in the board-connection connector pair of the present invention, the insertion member has a configuration in that a width of the insertion member is relatively wide at an entrance portion thereof and successively narrower with progression away from the entrance portion of the insertion member. A guide groove stopper is provided at an end portion of the respective guide.

On the other hand, in the board-connection connector pair of the present invention, at least one of the insertion member and the guide groove can be provided on a separate side wall portion on either one of the first and second planar housings.

Moreover, in the board-connection connector pair of the present invention, one of the board-connection connector has on the upper surface of its housing a protruding contact part that protrudes upward therefrom, the contact part having imparted to it springiness. When the insertion member of the other connector is slides so as to be inserted into the guide groove of the connector,the protruding contact part moves forward as it presses against a surface of contacts corresponding to the protruding contacts.

And further, in the board-connection connector pair of the present invention, both the board-connection connectors have on the upper surfaces a protruding contact part that protrudes upward therefrom, along with the guide groove, and aforementioned insertion member.

Yet another embodiment of the present invention will be described, with references made to FIG. 6(*a*) and FIG. 6(*b*).

Whereas in the first embodiment both the first connector and the second connector had guide grooves and insertion members, in the low-profile board-connection connector of this embodiment, only one of the connectors has insertion members, the other connector having only guide grooves.

Figure 6A:
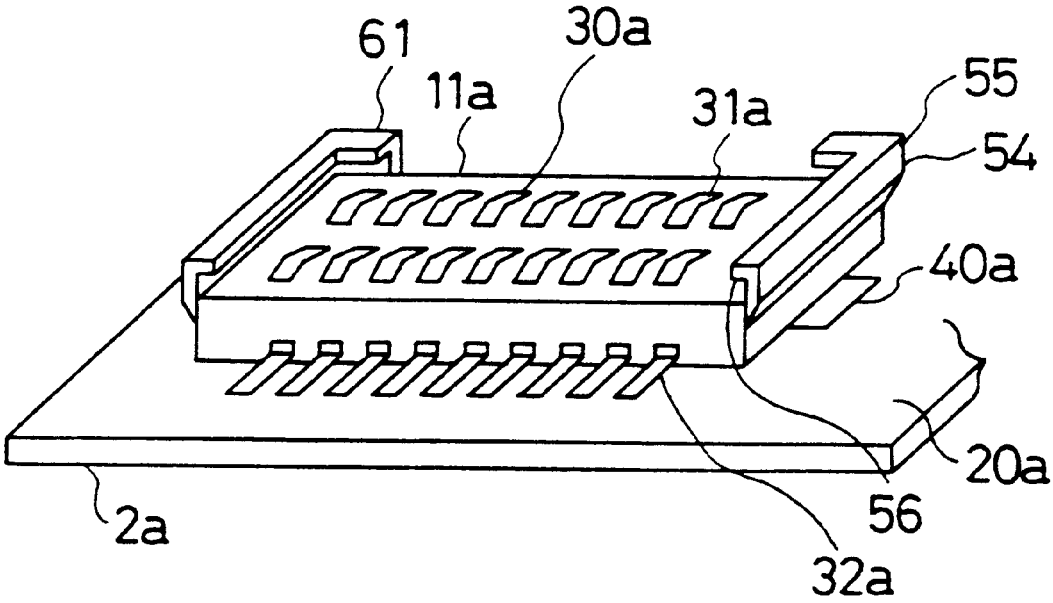
FIG. 6 is a perspective view of a low-profile board-connection connector according to the second embodiment of the present invention, with (a) showing the male connector and (b) showing the female connector.
Figure 6B:
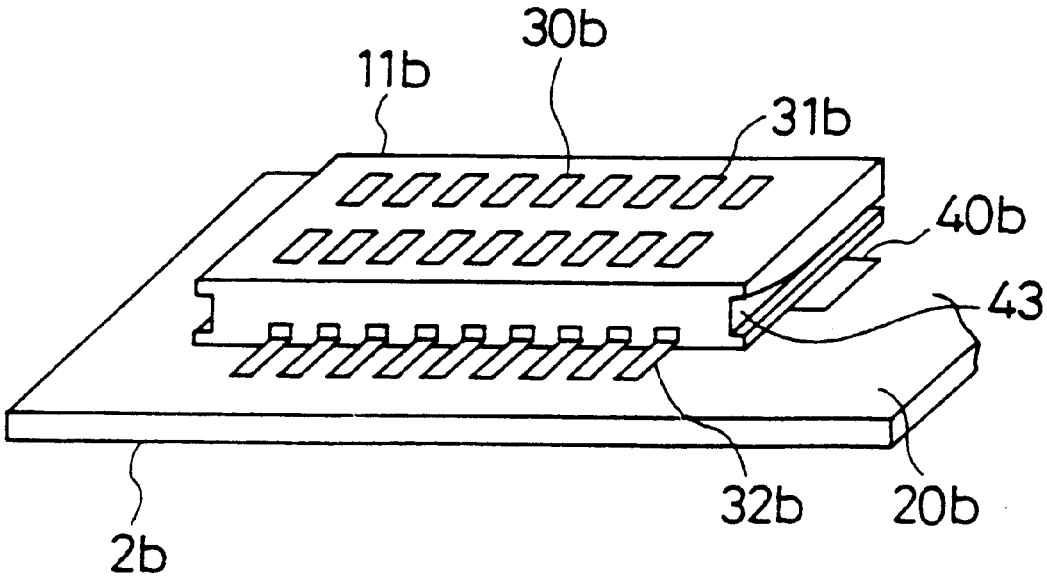

In FIG. 6, elements which are the same as in the first embodiment are assigned the same reference numerals, and in some cases will not be explicitly described.

FIG. 6(*a*) shows a perspective view of the first connector 2*a*, and FIG. 6(*b*) shows a perspective view of the second connector 2*b*.

The first connector, i.e., male connector 2*a* of this low-profile board-connection connector pair is almost the same as the first embodiment with regard to the housing thereof.

That is, it has a thick, rectangular planar housing 11*a*. A plurality of the first contacts 30*a* are made of band-shape metal strips and arranged so that each is parallel to the main sliding direction of the housing 11*a*.

These first contacts 30*a* form a protruding contact part 31*a* that protrudes from the upper surface of the first housing 11*a* so as to be exposed, and also form a terminal part 32*a*, which protrudes from the front side surface of the housing.

The protruding contact part 31*a* arches upward from the surface of the first housing 11*a*, this shape imparting a springiness to the contacts. The housing 11*a* is fixed to the first electronic circuit board 20*a* by means of the terminal part 32*a* and a solder reinforcement fixture 40*a*.

On each side surface of the first housing 11*a*, in parallel with the main sliding direction, there is provided a first insertion member 54 that protrudes upwardly.

These first insertion members 54 have a pair of support plates 55 which protrude perpendicularly to the upper surface of the housing 11*a* along the entire side of the housing 11*a* in the main sliding direction Mating Protrusions 56 are disposed at the end parts of these support plates 55 protruding horizontally toward the housing.

These mating protrusions 56 mate with the guide grooves 43 of the second connector 2*b*, which is described later.

Additionally, the rear side surface of the first housing 11*a* has stoppers 61 that protrude out perpendicularly with respect to the first housing 11*a*.

These stoppers 61 are formed as one with the insertion members 54.

The second connector, i.e., a female connector 2*b*, has a second housing 11*b*, similar to the first connector 2*a*. The contact part 31*b* having the second contacts 30*b*, in contrast to the first connector, is of a height that is the same as, or slightly lower than, the upper surface of the housing 11*b*.

On both sides of the second housing 11*b*, in parallel with the main sliding direction, there are provided first guide grooves 43 along the entire side surface length. The insertion sides of these guide grooves 43 are slightly enlarged, so as to facilitate insertion.

To make connection between the first connector and the second connector described above, similar to the case described with regard to the first embodiment, the first insertion member 54 of the first connector 2*a* is aligned with the first guide groove 43 of the second connector 2*b*, and the connectors 2*a* and 2*b* are moved forward, thereby causing the first insertion member 54 of the first connector 2*a* to be slid into the guide groove 43 of the second connector 2*b*.

Then, the front side surface of the housing 11*b* of the second connector 2*b* makes contact with the stopper 61 of the first connector 2*a*. The inserting at this point insertion ceases.

During this sliding action, the protruding contact part 31*a* having the first contacts, presses onto the contact part 31*b* having the second contacts as these contact parts move forward toward each other.

In this embodiment, in addition to the effect achieved by the first embodiment, because the upper surfaces of the housings are sliding on each other from the beginning of the sliding mating action, a better wiping effect is achieved. Additionally, the mating distance is longer, this being advantageous in terms of strength.

The low-profile board-connection connector according yet another embodiment of the present invention is a hermaphroditic connector, which serves as both the first connector and the second connector.

Figure 7:
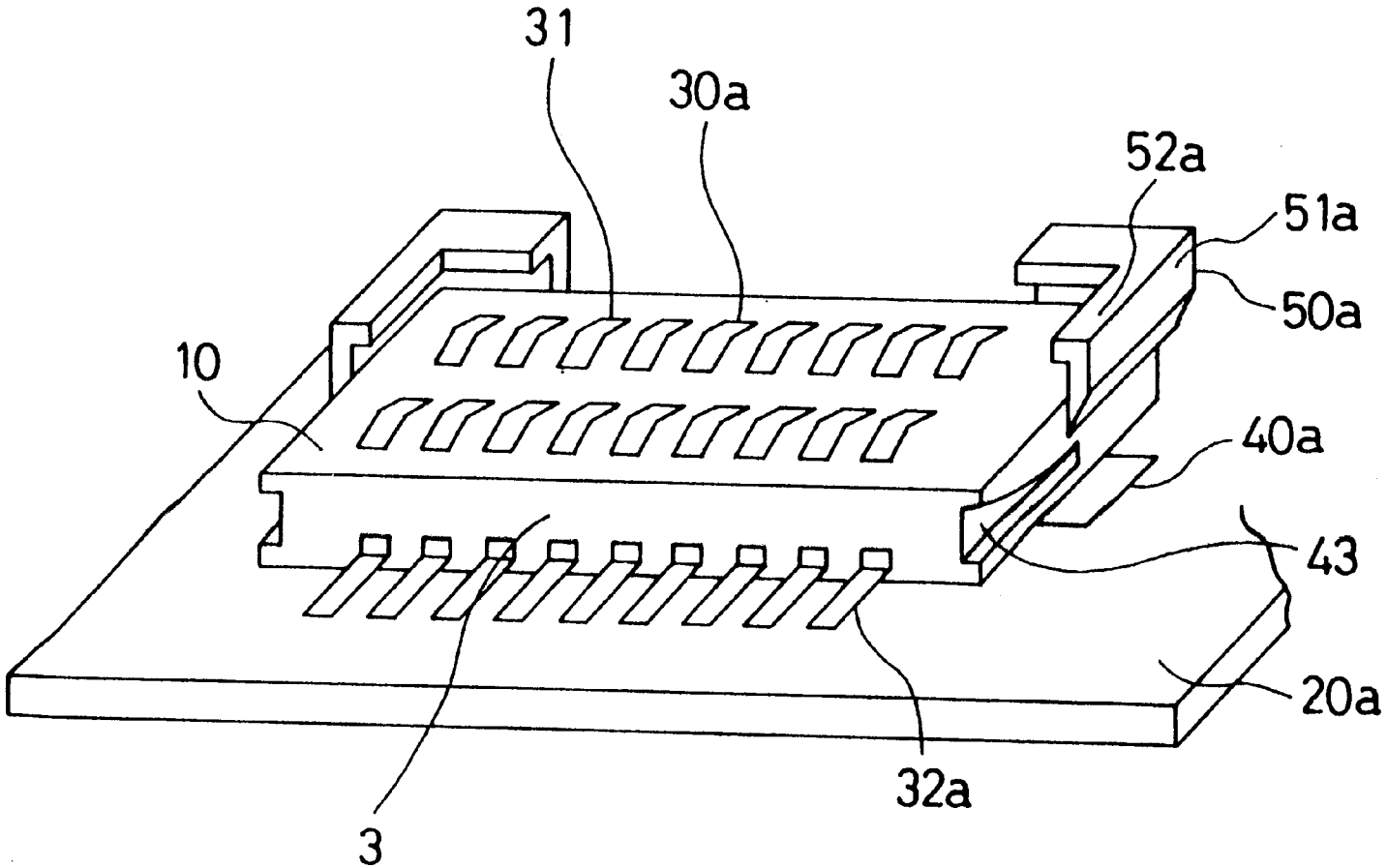
FIG. 7 is a perspective view of a low-profile board-connection connector according to the third embodiment of the present invention.
Figure 8:
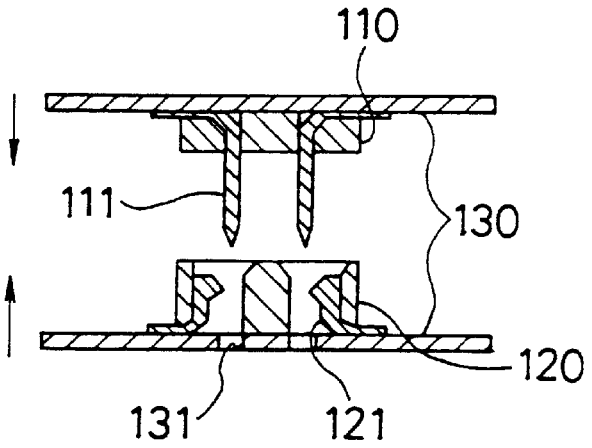
Fig. 8 (a) PRIOR ART
FIG. 8 is a side view which shows a vertical connector of the past, with (a) showing the condition before mating and (b) showing the mated condition.
Figure 8:
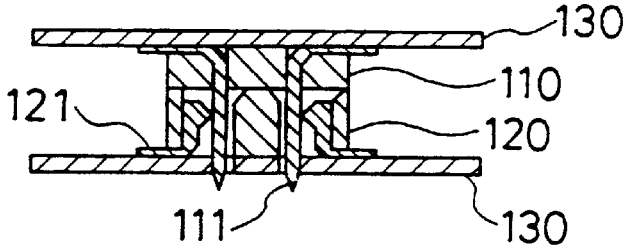
Fig. 8 (b) PRIOR ART
Figure 9:
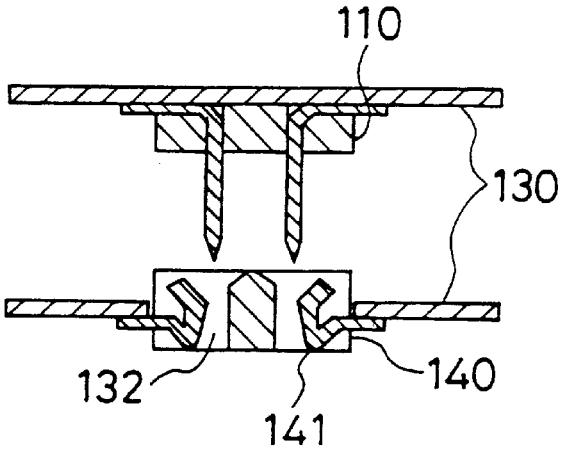
Fig. 9 (a) PRIOR ART
FIG. 9 is a side view which shows another vertical connector of the past, with (a) showing the condition before mating and (b) showing the mated condition.
Figure 9:
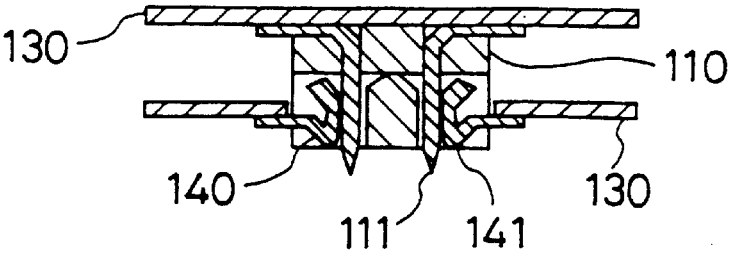
Fig. 9 (b) PRIOR ART

FIG. 7 shows a perspective view of this hermaphroditic low-profile board-connection connector according to this embodiment.

This low-profile board-connection connector 3 is basically the same as the first connector 1*b* which is shown in FIG. 1(*a*), the second connector thus having the same protruding contact part with springiness imparted to it as the the first connector.

For this reason, elements of the connector shown in FIG. 7 which are the same as elements in FIG. 1(*a*) are assigned the same reference numeral, and the descriptions thereof will be omitted.

Since in the low-profile board-connection connector of the first embodiment of the present invention the difference between the first and the second connectors is whether or not the contacts have springiness imparted to them, by imparting springiness to the second contacts as well, it is possible to implement a completely hermaphroditic connector.

For this reason, it is only necessary to manufacture one type of connector, so that, compared with the case of manufacturing two types of connectors, it is possible to reduce the manufacturing facilities required, and thus producing a large savings in cost.

In the above-noted embodiment, although the protruding contacts are described as being arched outward, any shape that protrudes from the upper surface of the housing can be used. For example, it is possible to use pins that are pushed up by a spring so that they can be freely extended and retracted.

As described in detail above, a low-profile board-connection connector according to the present invention enables the dimension between boards to be made very small, thereby contributing to high-density mounting. It also facilitates wiping action, thereby enabling the attainment of a highly reliable contact. Additionally, it is possible to combine the first connector and the second connector in a hermaphroditic connector, thereby achieving a cost reduction.

What is claimed is:

1. A pair of board-connection connectors which connect electronic circuit boards, said connectors comprising:

a first board-connection connector including a first electronic circuit board and a first housing, said first housing including side wall portions and being mounted on a surface of said first electronic circuit board, said first board-connection connector further including a plurality of first contacts provided on a main surface of said first housing; and a second board-connection connector including a second electronic circuit board and a second housing, said second housing including side wall portions and being mounted on a surface of said second electronic circuit board, said second board-connection connector further including a plurality of second contacts provided on a main surface of said second housing and each of said plurality of second contacts corresponding to respective first contacts; wherein:

said side wall portions extend from respective surfaces of said first and second electronic circuit boards in a direction substantially perpendicular to a main sliding direction in which said first and second housings are moved relative to one another when said first and second board-connection connectors are mated;

on at least one of said side wall portions of said first housing of said first electronic circuit board, a first guide groove is provided which extends in a direction parallel with said sliding direction; and on at least one of said side wall portions of said second housing of said second electronic circuit board, and corresponding to said first guide groove of said first housing, a first insertion member is provided which is effective to be inserted into said first guide groove, whereby said first and second contacts contact each other when said first insertion member and said first guide groove are mated.

2. A board-connection connector pair according to claim 1, wherein said first contacts are band-shaped, arranged so as to be parallel to said main sliding direction of said housings, and arranged along upper surfaces of said housings.

3. A board-connection connector pair according to claim 1, wherein at least one of said first insertion member and said first guide groove is disposed along a full range of a length of a respective side wall portion.

4. A board-connection connector pair according to claim 1, wherein at least one of said first insertion member and said first guide groove is disposed along a partial range of said respective side wall portions.

5. A board-connection connector pair according to claim 4, wherein both of said first insertion member and said first guide groove are provided on a corresponding side wall portion of a respective first and second planar housing and along a partial range of a length of said wall portion.

6. A board-connection connector pair according to claim 5, wherein said first guide groove and a second insertion member are provided on said side wall portion of said first planar housing, and said first insertion member and a second guide groove are provided on said side wall portion of said second housing.

7. A board-connection connector pair according to claim 6 wherein said first and second insertion members are provided on a portion of said first and second housings, respectively, which is close to a rear end thereof with respect to said main sliding direction.

8. A board-connection connector pair according to claim 6 wherein said first and second guide grooves are provided on a portion of said first and second housings, respectively, which is close to a front end thereof with respect to said main sliding direction.

9. A board-connection connector pair according to claim 5, wherein each one of said first and second board-connection connectors has a guide groove and an insertion member, so the said insertion members are mated by inserting into the corresponding guide grooves.

10. A board-connection connector pair according to claim 3, wherein a stopper is provided at an end portion of said first insertion member.

11. A board-connection connector pair according to claim 1, wherein said first guide groove has a configuration in that a height of said first guide groove is relatively wide at an entrance portion thereof and becomes successively narrower with progression away from said entrance portion of said first guide groove.

12. A board-connection connector pair according to claim 1, wherein at least one of said first insertion member and said first guide groove is provided on a separate side wall portion opposite to said side wall portion either one of said 1 first and second planar housing.

13. A board-connection connector pair according to claim 1, wherein one of said plurality of contacts has a protruding contact part that protrudes upward therefrom, said protruding contact part having imparted to its springiness, so that when said board-connection connectors are mated, said protruding contact part presses against a surface of the other of said plurality of contacts corresponding to said protruding contact parts.

14. A board-connection connector pair according to claim 2, wherein both said board-connection connectors have a protruding contact part that protrudes upward therefrom.

15. The board-connection connector pair as claimed in claim 1 wherein said housings are planar.

16. The board-connection connector pair as claimed in claim 1 wherein:

each of said board-connection connectors has at least two side wall portions on said housings; and each of said board-connection connectors has an insertion member and a guide groove on both of said two side wall portions.

17. A method of coupling a first board connection connector with a second board connection connector, said first board connection connector having a first housing disposed thereon, a first plurality of contacts disposed on top of said first housing, and a first insertion member disposed on a side of said first housing, said second board connection connector having a second housing disposed thereon, a second plurality of contacts disposed on top of said second housing, and a first guide groove disposed on a side of said second housing, said method comprising:

sliding said first insertion member of said first board connection connector, in a sliding direction substantially parallel to said first guide groove and said first insertion member, into said first guide groove of said second board connection connector thereby mating said first and second plurality of contacts and coupling said first board connection connector and said second board connection connector.

18. The method of claim 17, wherein, said first housing further includes a second guide groove and said second housing further includes a second insertion member.

19. The method of claim 17, wherein said first guide groove and said first insertion member extend along all of said sides of respective first and second housings.

20. The method of claim 17, wherein a stopper is provided at an end of said insertion member.

21. The method of claim 17, wherein said guide groove has a height which decreases in said sliding direction.

22. The method of claim 17, wherein at least one of said first and second contacts extends away from a respective first and second housing thereby imparting a springiness to said contacts.

23. The method as claimed in claim 17, wherein:

each of said board-connection connectors has at least two side wall portions on said housings; and each of said board-connection connectors has an insertion member and a guide groove on both of said two side wall portions.

* * * * *